United States Patent [19]

Smallegan et al.

[11] Patent Number: 4,875,352

[45] Date of Patent: Oct. 24, 1989

[54] CONSTRUCTION KEYING

[75] Inventors: Jon M. Smallegan, San Mateo; Richard R. Bettger, San Francisco, both of Calif.

[73] Assignee: Schlage Lock Company, San Francisco, Calif.

[21] Appl. No.: 48,441

[22] Filed: May 11, 1987

[51] Int. Cl.[4] ..... E05B 19/08

[52] U.S. Cl. ..... 70/395; 70/400; 70/401; 70/454

[58] Field of Search ..... 70/395, 400, 401, 453, 70/454, 339; 29/278

[56] References Cited

U.S. PATENT DOCUMENTS

| | | | |
|---|---|---|---|
| 420,174 | 1/1890 | Taylor | 70/453 |
| 660,230 | 10/1900 | Treat | 70/339 |
| 917,365 | 4/1909 | Schoell | 70/401 |
| 1,417,148 | 5/1922 | Diesel et al. | 70/339 |
| 1,587,686 | 6/1926 | Varnum | 70/339 |
| 1,662,613 | 3/1928 | Laynor | 70/395 |
| 1,728,310 | 9/1929 | Sundel | 70/395 |
| 1,900,185 | 3/1933 | Long | 70/400 |
| 1,979,798 | 11/1934 | Glidden | 70/395 |
| 2,591,652 | 4/1952 | Ziegliss | 70/395 |
| 2,945,373 | 7/1960 | Powers | 70/395 |
| 3,243,979 | 4/1966 | Silvern | 70/401 |
| 3,267,707 | 8/1966 | Adams | 70/395 |
| 3,276,233 | 10/1966 | Russell et al. | 70/395 |
| 3,338,078 | 8/1967 | Eberitch et al. | 70/395 |
| 3,408,942 | 11/1968 | Barnes et al. | 70/395 |
| 3,475,934 | 11/1969 | Reisner | 70/395 |
| 3,714,804 | 2/1973 | French | 70/395 X |
| 4,120,184 | 10/1978 | Gerlach | 70/395 X |

FOREIGN PATENT DOCUMENTS

| | | | |
|---|---|---|---|
| 289878 | 9/1966 | Australia | 70/395 |
| 240595 | 11/1911 | Fed. Rep. of Germany | 70/400 |
| 135645 | 11/1933 | Fed. Rep. of Germany | 70/400 |
| 2442681 | 3/1976 | Fed. Rep. of Germany | 70/400 |
| 2436235 | 5/1980 | France | 70/395 |

*Primary Examiner*—Lloyd A. Gall

*Attorney, Agent, or Firm*—Walter C. Vliet

[57] ABSTRACT

The invention comprises a two part key which replaces a conventional key in a conventional lock cylinder for purpose of temporary use wherein one of the parts is a plastic or similar material insert which replaces a portion of the conventional key and a short conplementary key which permits operation of the lock in conjunction with the insert. The insert being secured in the cylinder by means of the cylinder locking pins and being removable only by means of a special installation and extraction tool.

4 Claims, 2 Drawing Sheets

FIG. 1
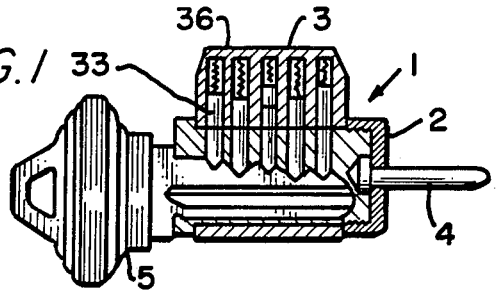
PRIOR ART
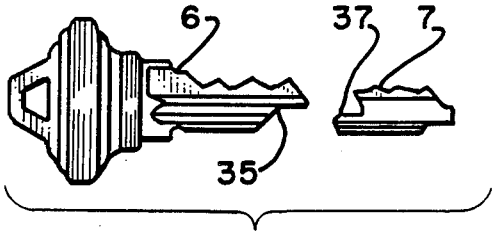
PRIOR ART
FIG. 2
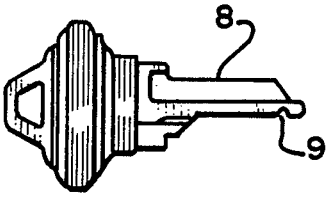
PRIOR ART
FIG. 3
FIG. 5
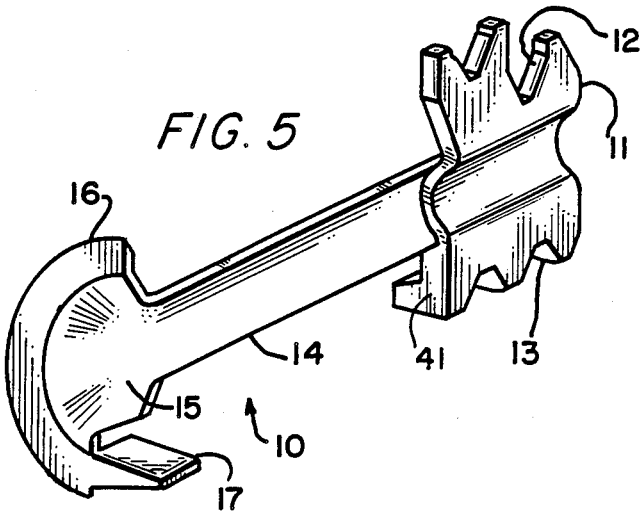
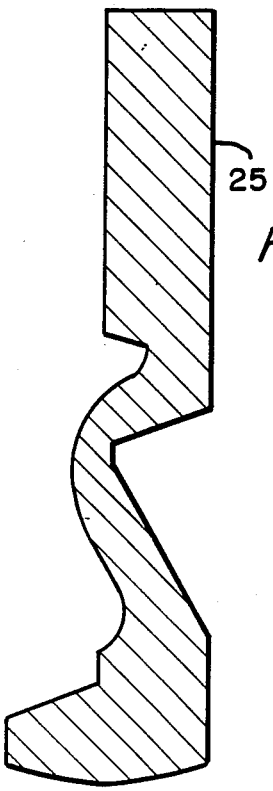
FIG. 4
FIG. 6
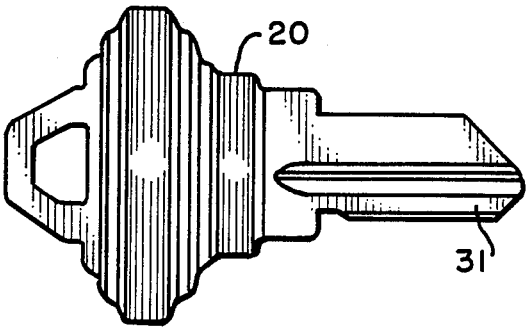
FIG. 7
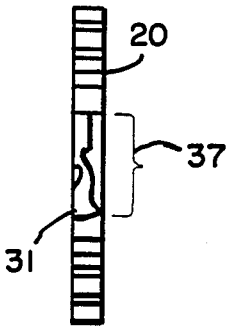

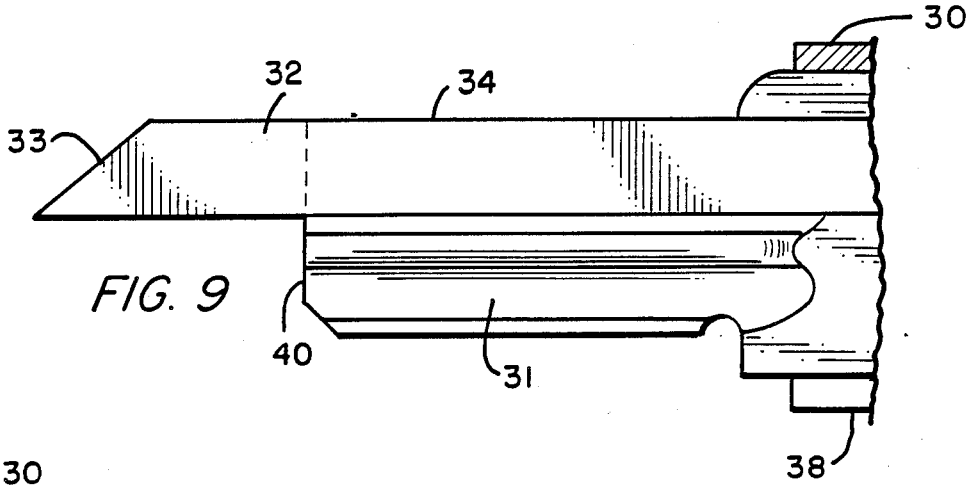
FIG. 9
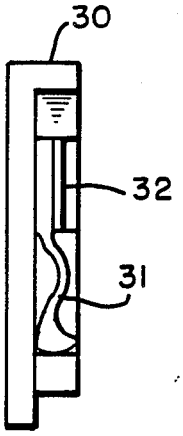
FIG. 11
FIG. 10
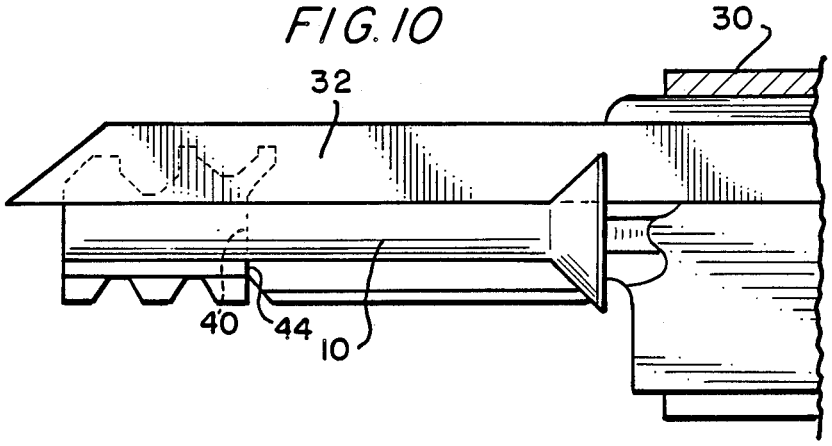
FIG. 8
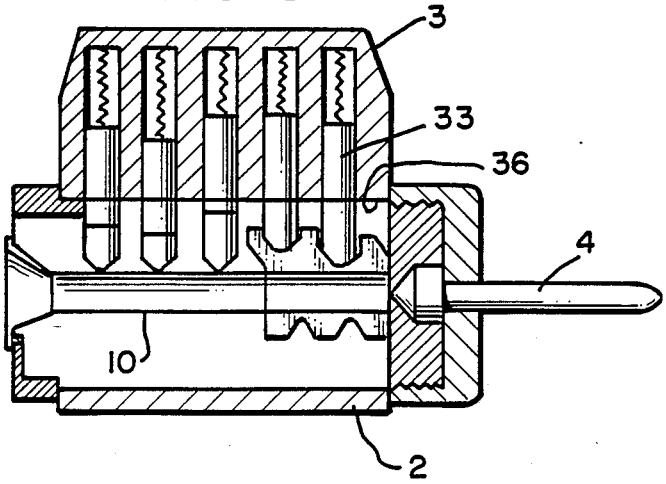

CONSTRUCTION KEYING

BACKGROUND OF THE INVENTION

The purpose of this system is to permit entrance to a facility under construction or remodeling by specific construction personnel and thereafter restrict their entrance. This means is commonly referred to as construction keying.

In application, the management supplies to the construction worker, a specially cut key. This key will operate a specific combination lock only when a device called an "insert" has been previously placed in the keyway of the lock. Installation of the insert would normally be installed in the factory but can also be field installed. The owner at its will can extract the insert from the lock, thereby disabling the worker's key. This is accomplished by a unique tool called the Insertion-/Extraction Tool. Upon completion of the work, the owner would remove the insert and supply his designated occupants with a regular change key to operate the lock.

The economical and easy-to-install system of the present invention does not take away any master key combinations or limit any other special features effecting normal keying practices.

OBJECTS OF THE PRESENT INVENTION

It is an object of the present invention to provide a system to restrict entrance to a facility under construction or remodeling, to specific construction personnel. It is a further object of this invention to provide a simple and secure method of providing construction keying. It is a further object of this invention to provide a reliable system which permits easy insertion and extraction of the insert. It is yet a further object of this invention to provide an inexpensive insert capable of manufacture from molded plastic. It is yet a further object of the present invention to provide a unique installation and extraction tool which permits ready insertion and extraction of the insert. It is yet a further object of the present invention to provide a construction key having a modified cross-section which permits overlapping engagement with a portion of the construction key insert. It is yet a further object of the present invention to provide a construction key insert which is readily removable and thereafter permit the use of a standard key in a standard lock cylinder.

The following additional objects are obtained:

The conical section provides a visual identifier to the user to indicate whether or not a cylinder is construction keyed;

The system provides versatility in minimizing the number of combinations of a potential key system which must be sacrificed to provide a construction key system;

The cylinders used in construction keying require no modification to accept the system;

No residual trace of the construction keyed system remains with the cylinder after the insert is removed; and Keys other than the construction key are blocked and cannot enter the cylinder when it is construction keyed.

These and other objects are obtained in a construction keying system as follows; a construction key insert comprising a means for combinating a plurality of cylindrical lock pin tumblers, a guide means for accommodating entrance of a construction key to a keyway accessing skid pin tumblers, and means connecting the means for combination and the guide means for effecting insertion and removal of the means combinating.

DESCRIPTION OF THE DRAWINGS

FIG. 1 shows a cross section of a conventional pin cylinder for a lock having a key inserted therein.

FIG. 2 shows a two-part construction key of the prior art.

FIG. 3 shows a construction key insert extractor of the prior art.

FIG. 4 is a sectional end view of a key section in common lock usage and for use with the present invention.

FIG. 5 is a pictorial isometric view of the construction keying insert according to the present invention.

FIG. 6 is a side elevation view of a construction key, according to the present invention.

FIG. 7 is an end view of the construction key shown in FIG. 6.

FIG. 8 is a cross section of the pin cylinder according to the present invention with the construction keying insert in place.

FIG. 9 is a side elevation of the insert tool required to insert the construction key insert.

FIG. 10 shows the construction key insert in place on the insert tool.

FIG. 11 is an end view of the construction key insert in place on the insert tool.

DESCRIPTION OF THE PREFERRED EMBODIMENT

FIG. 1 shows a lock cylinder generally designated by reference numeral 1, having a cylinder portion 2, a conventional pin chest 3, an actuator extending from the cylinder 4, and a key 5, inserted in the lock cylinder. In conventional operation the key aligns the pins 33, along a shear line 36, which permits the cylinder to rotate with the key in place, thereby permitting the actuator 4 to open the lock.

FIG. 2 shows a conventional construction key 6, and separated insert 7, generally formed from the key by arcuate cut 35. In the prior art the insert was forced into the cylinder to engagement with the last two or three pins and left there during the construction phase. The construction key contains a reduced number of combinations, that is, the number of combinations required, less the number contained on the insert to operate the lock during the construction phase. The construction key was inserted and the lock operated in a normal fashion. After the construction phase, the insert 7 was removed by means of an extractor key 8. The extractor key was provided with a section which lifted all pins to clear the path for removal of the insert 7, and in addition, contained an extractor notch 9, which engaged a ridge 37, provided on the insert 7, for removal. Upon removal of the insert, construction keys are rendered inoperable and the lock reverts to a conventional lock, as shown in FIG. 1.

As previously mentioned, certain combinations presented problems for removal of the insert, due to the lead in requirements on the construction key, necessary to lift the lock pins 33. This necessitated an occasional assist from a locksmith to remove the insert 7.

In order to control the number of key sections which will fit a particular lock cylinder, a unique key section is utilized which permits only key blanks having the appropriate cross section to enter the cylinder and operate the pins. This provides additional security, and a typical key section is shown on FIG. 4, with reference numeral 25. The present invention improves the insertability and removal of the construction insert. In the present invention, a molded plastic insert shown in FIG. 5, is provided with an insert tip 11, having one or more combinations 12, provided on its upper surface. A guard or guide cone 15, having a collar 16, and an orientation keeper 17, is connected to the insert tip 11, by means of a shank or tang 14, formed of a cylinder segment. For certain cylinders having functions, ward notches 13, are provided on the insert tip. The construction insert generally designated by the reference numeral 10, may be molded from any one of a number of available materials.

As shown in FIG. 5, the combinated end 11 of the construction insert, carries two key cuts 12, to combinate or align the cylinder pins with the shear line to permit cylinder rotation. It functions and is located as if it were the end of a regular change key and has a cross section which allows it to fit a large family of key sections. The design of the key cut profile is shaped so that the cylinder pins will drop into it and restrict the insert's movement. In this state, the insert cannot be removed without the unique insertion-extraction tool 30, as seen in FIG. 9.

The insert tip end 11, is so designed that adequate space between it and the key wall will permit the insertion tool blade 32, to pass along its side. This permits the tool blade to lift the cylinder pins trapped by the key cuts and thereby permits insertion and removable. A two pin tip, as shown, provides nearly one hundred (100) different insert combinations, compatible with current keying techniques. The shank or tang 14, is a specially designed connector with a unique cross section which couples the insert end with the guard or guide cone 15. This cross section mates with a similar milled area in the construction key and the insertion tool. This configuration is compatible with current Schlage key sections. The tang 15, is positioned so as to allow the construction key entrance to the keyway and to allow the key to run beside it. The key guard's, primary functions are to position and locate the insert in order to line up the combinated ends of cylinder pins loaded in the cylinder, to provide a lip 16 to clasp onto for removing the insert and to prevent non-construction keys from entering the keyway. The guard prevents the tang from obstructing the entrance of the construction key. It also by its conical shape assists the construction key in finding and entering the keyway. The conical guard also provides a visual indicator that the cylinder is construction keyed.

FIGS. 6 and 7 show a construction key blank 20, for use with the new construction insert. In the case of a five pin cylinder it would be cut with three additional key combinations. The three key combinations of the key blank 20, in combination with the two key combinations of the insert tip 11, form the five key combinations necessary to align the cylinder pins 33, at the shear line 36, as required for cylinder operation.

FIG. 10 shows the insert tool 30 and construction insert 10, in assembled relationship in preparation for insertion into the key cylinder key slot.

The end 40 of the modified key section butts against a land 41 of insert tip 11 to push the insert tip 11 into the keyway which is further facilitated by support of the blade 32 and the lift of the lock pins by the edge of the blade to permit entry. On removal the lip 16 is engaged by a fingernail and the insert 10 is removed along with the insert tool 30.

FIG. 7 shows the end view of the construction key 20, with the modified key section 31, milled back in the area bracketed by the reference numeral 37, to permit parallel commingling of the construction key and the construction insert tang in the key slot. As previously stated, FIG. 9 shows a side view of the insert tool 30, required to insert the construction insert 10, in a lock. The insert-extraction tool is comprised of a holder 38, partially shown, and which may be of any convenient construction, preferably one that would permit retraction of the key section guide 31, and blade 32, into the holder for protection or alternately exposure when required. The extractor portion of the tool is composed of a modified key section 31, shown in end view in FIG. 11, which is further cut back to permit both the commingling of the blade, the key section and the insert tang, and insert tip in parallel relationship in the key slot.

FIG. 8 shows the construction insert 10, inserted in a conventional five pin lock cylinder holding the last two conventional pins 33, at the shear line 36. The construction key, of course, may be manufactured from standard key blank material and may be produced in different lengths and sections compatible with standard cylinders. The construction keys may also be acquired with ward by-pass cuts for warded cylinder systems and may also be acquired in combination as a master key for management use in master key systems.

With the construction insert in place only properly combinated and properly milled construction keys will fit in and operate the lock. As may now be appreciated by one skilled in the art, this new construction key system allows a new facility to be construction keyed at the factory using a convenient, economical, and easy to install insert which can later be field removed. It also allows an existing facility to be construction keyed without changing its key combination system. The use of the system does not take away any master key combinations or limit any other special features affecting normal keying practice.

Having described my invention in terms of a best mode, numerous other combinations embodying the concept of this invention will become apparent to one skilled in the art. I therefore do not wish to be limited in the scope of my invention except as claimed.

I claim:

1. A substantially solid construction key insert for changing the combination of a cylindrical lock comprising: means for combinating a first plurality of cylindrical lock pin tumblers; guide means for accommodating entrance of a construction key to a keyway accessing said first plurality of pin tumblers and a second plurality of pin tumblers; means for connecting said means for combinating and said guide means for effecting insertion and removal of said means for combinating; and said means for connecting cohabits said keyway with a modified key section for combinating said second plurality of pin tumbers of a construction key in side by side relationship about a plane parallel to the plane of the longitudinal axis of said cylindrical lock pin tumblers during operation of the lock.

2. A construction key insert according to claim 1 wherein:

said means for combinating further comprises a partial key having at least one defined land for positioning said pin tumblers.

3. A construction key adapted for use with a substantially solid construction key insert for a cylindrical lock cylinder of the type having means for combinating a first plurality of lock pin tumbers, disposed in linear planar array, guide means for accommodating entrance of a construction key, and a tang connecting said means comprising: a shortened modified key section of reduced width cross section which permits said construction key to cohabit with said tang in a keyway in side by side relationship about a plane parallel to the plane of the longitudinal axis of said cylindrical lock pin tumblers and said construction key further includes means for combinating a second plurality of lock pin tumblers.

4. A tool adapted for insertion of a construction key insert of the type having means for combinating a first plurality of lock pin tumblers disposed in linear planar array for a cylindrical lock cylinder, guide means for accommodating entrance of a construction key, and a tang connecting said means, comprising: a key section guide for positioning said tang in a key slot and a blade means for accommodating entrance and removal of said combinating means in a combinated keyway, and said key section guide forms a butting end to end contact in said key slot with a longitudinal end of said means for combinating to effect insertion, and said blade means effects lift of said first plurality of pin tumblers and a second plurality of pin tumbers to effect insertion and removal of said construction key insert.

* * * * *